US009786171B2

(12) United States Patent
Prokhorov

(10) Patent No.: US 9,786,171 B2
(45) Date of Patent: Oct. 10, 2017

(54) SYSTEMS AND METHODS FOR DETECTING AND DISTRIBUTING HAZARD DATA BY A VEHICLE

(71) Applicant: Toyota Motor Engineering & Manufacturing North America, Inc., Erlanger, KY (US)

(72) Inventor: Danil V. Prokhorov, Canton, MI (US)

(73) Assignee: TOYOTA MOTOR ENGINEERING & MANUFACTURING NORTH AMERICA, INC., Erlanger, KY (US)

( * ) Notice: Subject to any disclaimer, the term of this patent is extended or adjusted under 35 U.S.C. 154(b) by 0 days.

(21) Appl. No.: 15/006,910

(22) Filed: Jan. 26, 2016

(65) Prior Publication Data

US 2017/0213462 A1 Jul. 27, 2017

(51) Int. Cl.
*G08G 1/00* (2006.01)
*G08G 1/0967* (2006.01)

(52) U.S. Cl.
CPC ..... *G08G 1/096791* (2013.01)

(58) Field of Classification Search
CPC ..... G08G 1/096791
USPC ..... 340/901, 902, 903
See application file for complete search history.

(56) References Cited

U.S. PATENT DOCUMENTS 5,568,127 A 10/1996 Bang
5,907,293 A 5/1999 Tognazzini
6,246,932 B1 6/2001 Kageyama et al.
6,252,544 B1 6/2001 Hoffberg
6,275,773 B1 8/2001 Lemelson et al.
6,313,758 B1 11/2001 Kobayashi
6,349,001 B1 2/2002 Spitzer
6,356,839 B1 3/2002 Monde et al.
(Continued)

FOREIGN PATENT DOCUMENTS

CN 202722736 U 2/2013
DE 102004037733 3/2006
(Continued)

OTHER PUBLICATIONS

Caperna et al.; "A Navigation and Object Location Device for the Blind"; Tech, rep. University of Maryland College Park; 129 pages; 2009.

(Continued)

*Primary Examiner* — Qutbuddin Ghulamali
(74) *Attorney, Agent, or Firm* — Snell & Wilmer LLP

(57) ABSTRACT

A system for transmitting data corresponding to hazards from a first vehicle to a second vehicle includes a first sensor for detecting first hazard data corresponding to a potential hazard and a second sensor, being of a different type than the first sensor, for detecting second hazard data corresponding to the potential hazard. The system also includes a network access device for receiving and transmitting signals and an electronic control unit (ECU) that is coupled to the first sensor, the second sensor and the network access device. The ECU determines whether the potential hazard exists based on the first and second hazard data. The ECU also determines a category corresponding to the potential hazard. The ECU also instructs the network access device to transmit potential hazard data corresponding to the potential hazard to the second vehicle when the category is a first category.

20 Claims, 8 Drawing Sheets

(56) References Cited

U.S. PATENT DOCUMENTS

| | | | | |
|---|---|---|---|---|
| 6,502,035 | B2 | 12/2002 | Levine | |
| 6,603,863 | B1 | 8/2003 | Nagayoshi | |
| 6,683,539 | B2 | 1/2004 | Trajkovic et al. | |
| 6,732,077 | B1 | 5/2004 | Gilbert et al. | |
| 6,792,351 | B2 | 9/2004 | Lutter | |
| 6,865,480 | B2 | 3/2005 | Wong | |
| 7,099,773 | B2 | 8/2006 | Linn | |
| 7,161,504 | B2 | 1/2007 | Linn | |
| 7,343,268 | B2 | 3/2008 | Kishikawa | |
| 7,425,903 | B2 | 9/2008 | Boss et al. | |
| 7,437,244 | B2 | 10/2008 | Okada | |
| 7,565,239 | B2 | 7/2009 | de Silva et al. | |
| 7,571,029 | B2 | 8/2009 | Dai et al. | |
| 7,633,407 | B2 | 12/2009 | Yano et al. | |
| 7,657,373 | B2 | 2/2010 | Kindo | |
| 7,693,654 | B1 | 4/2010 | Dietsch et al. | |
| 7,729,850 | B1 | 6/2010 | Kraft et al. | |
| 7,791,503 | B2 | 9/2010 | Breed et al. | |
| 7,804,423 | B2 | 9/2010 | Mudalige et al. | |
| 7,825,824 | B2 | 11/2010 | Shrum, Jr. | |
| 7,912,627 | B2 | 3/2011 | Downs et al. | |
| 7,979,198 | B1 | 7/2011 | Kim et al. | |
| 8,024,330 | B1 | 9/2011 | Franco et al. | |
| 8,123,660 | B2 | 2/2012 | Kruse et al. | |
| 8,134,478 | B2 | 3/2012 | Denaro | |
| 8,155,865 | B2 | 4/2012 | Bicego, Jr. | |
| 8,300,862 | B2 | 10/2012 | Newton et al. | |
| 8,354,942 | B2 | 1/2013 | Stahlin | |
| 8,406,998 | B2 | 3/2013 | Shaffer et al. | |
| 8,407,003 | B2 | 3/2013 | Geelen et al. | |
| 8,493,235 | B2 | 7/2013 | Stahlin | |
| 8,588,464 | B2 | 11/2013 | Albertson et al. | |
| 8,831,869 | B2 | 9/2014 | Bai et al. | |
| 8,907,814 | B2 | 12/2014 | Chen | |
| 8,935,034 | B1 | 1/2015 | Zhu et al. | |
| 9,031,779 | B2 | 5/2015 | Djugash | |
| 9,142,128 | B2 | 9/2015 | Shin et al. | |
| 2004/0064251 | A1 | 4/2004 | Miller et al. | |
| 2004/0107042 | A1 | 6/2004 | Seick | |
| 2007/0096892 | A1 | 5/2007 | Nathan et al. | |
| 2007/0150140 | A1 | 6/2007 | Seymour | |
| 2008/0033644 | A1 | 2/2008 | Bannon | |
| 2008/0059055 | A1 | 3/2008 | Geelen et al. | |
| 2008/0189039 | A1* | 8/2008 | Sadekar | G08G 1/096716 701/301 |
| 2008/0262670 | A1 | 10/2008 | McClellan et al. | |
| 2009/0037093 | A1 | 2/2009 | Kurihara et al. | |
| 2009/0140887 | A1 | 6/2009 | Breed et al. | |
| 2009/0210141 | A1* | 8/2009 | Young | G08G 1/0104 701/119 |
| 2009/0234859 | A1 | 9/2009 | Grigsby et al. | |
| 2009/0248289 | A1 | 10/2009 | Tanaka et al. | |
| 2010/0110368 | A1 | 5/2010 | Chaum | |
| 2010/0235088 | A1 | 9/2010 | Li et al. | |
| 2010/0245065 | A1* | 9/2010 | Harada | G01S 7/529 340/435 |
| 2010/0250106 | A1 | 9/2010 | Bai et al. | |
| 2010/0332119 | A1 | 12/2010 | Geelen et al. | |
| 2011/0043377 | A1 | 2/2011 | McGrath et al. | |
| 2011/0054689 | A1 | 3/2011 | Nielsen et al. | |
| 2011/0084824 | A1 | 4/2011 | Tewari et al. | |
| 2011/0112720 | A1 | 5/2011 | Keep et al. | |
| 2011/0153193 | A1 | 6/2011 | Fox et al. | |
| 2011/0224901 | A1 | 9/2011 | Aben et al. | |
| 2011/0307168 | A1 | 12/2011 | Kieff | |
| 2011/0313656 | A1 | 12/2011 | Mignen et al. | |
| 2012/0092460 | A1 | 4/2012 | Mahoney | |
| 2012/0162423 | A1 | 6/2012 | Xiao et al. | |
| 2012/0166074 | A1 | 6/2012 | Weng et al. | |
| 2012/0229302 | A1 | 9/2012 | Sri-Jayantha | |
| 2012/0270558 | A1 | 10/2012 | Busch et al. | |
| 2013/0115579 | A1 | 5/2013 | Taghavi | |
| 2013/0141576 | A1 | 6/2013 | Lord et al. | |
| 2014/0009307 | A1* | 1/2014 | Bowers | G08G 1/166 340/901 |
| 2014/0232565 | A1* | 8/2014 | Young | G08G 1/0104 340/934 |
| 2015/0161892 | A1* | 6/2015 | Oremus | G08G 1/165 340/901 |
| 2015/0198454 | A1 | 7/2015 | Moore et al. | |
| 2015/0199566 | A1 | 7/2015 | Moore et al. | |
| 2015/0201181 | A1 | 7/2015 | Moore et al. | |

FOREIGN PATENT DOCUMENTS

| | | |
|---|---|---|
| JP | 08210865 | 8/1996 |
| JP | 2005321323 | 11/2005 |
| WO | WO 2007/031782 | 3/2007 |
| WO | WO 2010/109313 | 9/2010 |
| WO | WO 2011/071826 | 6/2011 |

OTHER PUBLICATIONS

Burbey et al.; "Human Information Processing with the Personal Processing with the Personal Memex"; ISE 5604 Fall 2005; 88 pages; Dec. 6, 2005.

Ghiani, et al.; "Vibrotactile Feedback to Aid Blind Users of Mobile Guides"; Journal of Visual Languages and Computing 20; pp. 305-317; 2009.

NFB Article, "GPS technology for the blind, a product evaluation", National Federation of the Blind, Feb. 2006, 12 pages, downloaded from https://nfb.org/images/nfb/publications/bm/bm06/bm0602/bm060206.htm.

Jose Santo et al., "Sharing Context-Aware Road and Safety Information" Pervasive computing, IEEE CS 2009, pp. 58-65.

Jedrzej Rybicki et al., "Challenge: Peers on Wheels—A Road to New Traffic Information Systems", MobiCom2 2007, Sep. 9-14, 2007, Montreal, Quebec, Canada, 7 pages.

Simone Fuchs et al., "Context-Awareness and Collaborative Driving for Intelligent Vehicles and Smart Roads", University of Klagenfurt, Transportation Informatics, Department of Smart Systems Technologies, Klagen, Austria, 6 pages.

Subir Biswas et al., "Vehicle-to-Vehicle Wireless Communication Protocols for Enhancing Highway Traffic Safety", IEEE Communications Magazine, Jan. 2006, pp. 74-82.

DailyMail web page, "A road runs through it: resourceful engineers in crowded Japanese city buiild flyover via middle of an office block", Jan. 31, 2012, 5 pages, downladed from http://www.dailymail.co.uk/news/article-2093903/No-room-road-Japanese-engineers-just-build-straight -middle.html.

* cited by examiner

600

| CATEGORY | EXAMPLES | TRANSMIT TO | DATA TO TRANSMIT |
|---|---|---|---|
| EMERGENCY | DRUNK DRIVER | CORRESPONDING EMERGENCY PERSONNEL AND ALL VEHICLES IN RANGE/ALL VEHICLES POTENTIALLY IN DANGER | ALL RELEVANT DATA |
| | FIRE | | |
| | WRECK ON ROAD | | |
| HIGH LIKELIHOOD OF DANGER | APPROACHING EMERGENCY VEHICLE | ALL VEHICLES IN RANGE/ALL VEHICLES POTENTIALLY IN DANGER | CURRENT LOCATION OF DANGER, LOCATION OF POTENTIAL FUTURE DANGER, IMAGE DATA, VIDEO DATA |
| | VEHICLE BREACHING RIGHT OF WAY | | |
| DISTURBANCE | TRAFFIC | ONLY VEHICLES THAT DESIRE TO RECEIVE SUCH DATA | LOCATION OF DISTURBANCE, TYPE OF DISTURBANCE, IMAGE DATA |
| | POTHOLES | | |
| | OBJECTS IN THE ROAD | | |
| IDENTIFICATION OF PERSON/OBJECT OF INTEREST | IDENTIFICATION OF A STOLEN CAR | CORRESPONDING EMERGENCY PERSONNEL | LOCATION OF PERSON/OBJECT, IDENTIFICATION OF PERSON/OBJECT, IMAGE DATA, VIDEO DATA |
| | IDENTIFICATION OF A FUGITIVE | | |

FIG. 6

SYSTEMS AND METHODS FOR DETECTING AND DISTRIBUTING HAZARD DATA BY A VEHICLE

BACKGROUND

Field

The present disclosure relates to systems and methods for detecting and sharing hazard data by a vehicle and, more particularly, for detecting and sharing hazard data with other vehicles and/or authorities.

Description of the Related Art

Processors are being designed to be smaller, faster, more efficient and less expensive than ever. Due to the increased capabilities and reduced costs, vehicle manufacturers have been including more processors, and processor based functions in vehicles. For example, these processors (or electronic control units (ECUs)) now control many vehicle functions such as engine timing, transmission shifts and the like.

Vehicle manufacturers have begun to incorporate more types of sensors into vehicles. Data detected by the sensors can be used for multiple features by providing the data to ECUs. For example, some vehicle manufacturers now position a camera or sonar sensors on the rear of a vehicle. The data detected by the camera or sonar sensors is provided to an ECU and used to aid in reverse driving or maneuvers of the vehicle.

Sometimes data from these sensors is used to provide feedback for driving. For example, autonomous vehicles include various types of sensors positioned around the vehicle. The sensors detect data corresponding to the environment of the vehicle and provide a significant amount of data to one or more ECUs.

The information provided by these sensors is typically sufficient. However, it is sometimes desirable for an ECU to receive information corresponding to a location that is out of the operable range of the sensors. For example, it may be desirable for the ECU of a first vehicle to know if another vehicle will impermissibly enter an intersection that is out of range of the sensors of the first vehicle. Currently, this information can only be obtained once the intersection is within the range of the sensors of the first vehicle.

Thus, there is a need for systems and methods for detecting hazards and transmitting data corresponding to the hazard to other vehicles.

SUMMARY

Described herein is a system for transmitting data corresponding to hazards from a first vehicle to a second vehicle within a predetermined distance of the first vehicle. The system includes a first sensor for detecting first hazard data corresponding to a potential hazard and a second sensor for detecting second hazard data corresponding to the potential hazard. The first sensor is a different type of sensor than the second sensor. The system also includes a network access device for receiving and transmitting signals. The system further includes an electronic control unit (ECU) that is coupled to the first sensor, the second sensor and the network access device. The ECU determines whether the potential hazard exists based on the first hazard data and the second hazard data. The ECU also determines a category corresponding to the potential hazard. The ECU also determines potential hazard data corresponding to the potential hazard and instructs the network access device to transmit the potential hazard data to the second vehicle when the category is a first category.

Also described is a system for transmitting data corresponding to a hazard from a first vehicle to a second vehicle. The system includes a camera for detecting image data corresponding to a third vehicle. The system also includes a radar device or a light detection and ranging (LIDAR) device for detecting wave data corresponding to the third vehicle. The system also includes a network access device for receiving and transmitting signals. The system also includes an electronic control unit (ECU). The ECU determines whether the third vehicle presents a potential hazard based on the image data and the wave data. The ECU also determines a category of the potential hazard based on the image data and the wave data. The ECU also determines that potential hazard data corresponding to the potential hazard should be transmitted to the second vehicle when the category of the potential hazard is a first category. The ECU also instructs the network access device to transmit the potential hazard data to the second vehicle.

Also described is a method for detecting hazards by a first vehicle and transmitting hazard data to a second vehicle. The method includes detecting, by a first sensor, first hazard data and detecting, by a second sensor, second hazard data. The first sensor is a different type of sensor than the second sensor. The method also includes determining, by an electronic control unit (ECU), that a third vehicle is approaching an intersection. The method also includes determining, by the ECU, whether the third vehicle is a non-emergency vehicle and appears likely to breach a right of way or whether the third vehicle is an emergency vehicle based on the first hazard data and the second hazard data. The method also includes determining, by the ECU, that the third vehicle approaching the intersection presents a potential hazard when at least one of the third vehicle is the non-emergency vehicle and appears likely to breach the right of way or the third vehicle is the emergency vehicle. The method also includes transmitting, by a network access device, potential hazard data corresponding to the potential hazard to the second vehicle when the second vehicle is within a predetermined distance of the first vehicle.

BRIEF DESCRIPTION OF THE DRAWINGS

The features, obstacles, and advantages of the present invention will become more apparent from the detailed description set forth below when taken in conjunction with the drawings, wherein:

FIG. 6 is a table showing exemplary categories of potential hazards, exemplary potential hazards within each category, appropriate recipients of data corresponding to the potential hazards and types of data to be transmitted according to an embodiment of the present invention;

DETAILED DESCRIPTION

The systems and methods described herein provide several benefits and advantages over the current state of the art. The systems and methods provide benefits and advantages such as providing information to ECUs of autonomous vehicles and/or drivers of driven vehicles that corresponds to an area out of range of the vehicles' sensors. This makes the ECU or the driver aware of upcoming hazards. Having this out-of-range information provides benefits and advantages such as reducing the likelihood of driving related accidents. For example, it can reduce the likelihood of a collision with a speeding emergency vehicle, a collision with a vehicle being driven improperly or recklessly, driving over a hazard or an object in the road or the like. The systems and methods provide further benefits and advantages such as providing data corresponding to emergencies or illegal activities to authorities such as law enforcement, fire personnel, ambulance dispatchers or the like. The system provides further benefits and advantages such as robust detection of potential hazards. For example, the system can detect a hazard even if conditions in the environment limit the capabilities of one or more type of sensor.

An exemplary system may be used in a vehicle. The system includes a first type of sensor, such as a camera, and a second type of sensor, such as a radar device. The system also includes an environment sensor that detects data corresponding to an environment of the vehicle, such as a moisture sensor for detecting fog or rain. The system also includes a network access device capable of transmitting data to other vehicles within a predetermined distance of the vehicle and/or transmitting data to authorities. The system also includes an electronic control unit (ECU) coupled to the sensors, the environment sensor and the network access device. The ECU receives detected data from the sensors and determines whether the data indicates the presence of a potential hazard. The ECU categorizes the potential hazard and determines what actions to take with regard to the potential hazard based on its category.

Figure 1:
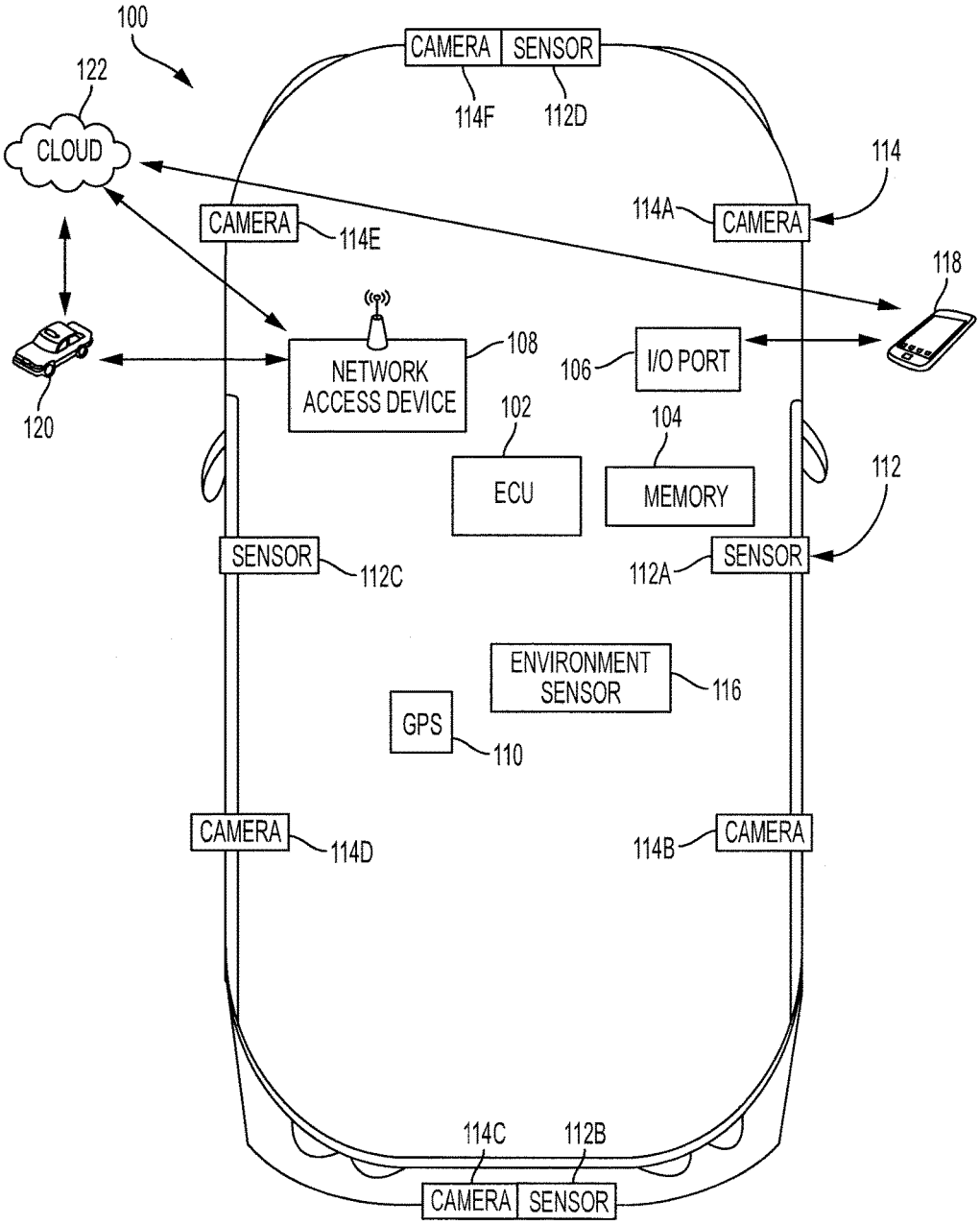
FIG. 1 is a block diagram of a vehicle having sensors for detecting data corresponding to a potential hazard and an ECU for distributing data associated with the potential hazard to at least one of another vehicle or authorities according to an embodiment of the present invention.

Turning to FIG. 1, a vehicle 100 is designed to detect and distribute hazard information to nearby vehicles. The vehicle 100 may be an autonomous vehicle, a semi-autonomous vehicle or a conventional driving vehicle. The vehicle 100 may continuously monitor its surroundings and may share vehicle information and impending traffic information with other vehicles.

The vehicle 100 may include an electronic control unit (ECU) 102, a memory 104, an input/output (I/O) port 106, a network access device 108 and a global positioning system (GPS) unit 110. The vehicle 100 may also include a plurality of sensors 112 including a sensor 112A, 112B, 112C and 112D, a plurality of cameras 114 including a camera 114A, 114B, 114C, 114D, 114E and 114F and an environment sensor 116.

The ECU 102 can include one or more processors or controllers, which may be specifically designed for automotive systems. The functions of the ECU 102 can be implemented in a single ECU or in multiple ECUs. The ECU 102 may receive data from components of the vehicle 100, may make determinations based on the received data and may control the operations of components based on the determinations.

The memory 104 may include any non-transitory memory known in the art. In that regard, the memory 104 may store machine-readable instructions usable by the ECU 102 and may store any other data as requested by the ECU 102.

The I/O port 106 can include any I/O port capable of receiving data from and/or transferring data to another device. The I/O port 106 may connect to other devices via a wired or wireless interface. For example, the I/O port 106 may include a USB port, a Wi-Fi port, a Bluetooth port or the like. The I/O port 106 may transmit data to and receive data from an external device such as a mobile phone 118. In that regard, the ECU 102 can communicate with the mobile phone 118 via the I/O port 106.

The network access device 108 may include any device capable of communicating with an external device or network. For example, the network access device 108 may communicate via vehicle-to-vehicle protocols (V2V), 3G protocols, 4G protocols or the like. In some embodiments, the network access device 108 may communicate directly with another vehicle 120 that is within a predetermined range of the network access device 108. In some embodiments, the network access device 108 may communicate with the vehicle 120 via the cloud 122. The vehicle 100 may also communicate with the other vehicle 120 via the I/O port 106 and the mobile phone 118, either directly or via the cloud 122.

The GPS unit 110 may include one or more GPS receivers capable of receiving location data corresponding to a current location of the vehicle 100. In that regard, the ECU 102 can determine a current location of the vehicle 100 based on data from the GPS unit 110.

The vehicle 100 may include any number of sensors 112. The sensors 112 may be any sensors capable of detecting data corresponding to an environment of the vehicle. For example, the sensors 112 can include one or more of a wave generation and sensing device (wave device, such as a LIDAR device, a radar device or a sonar device), a camera or other imaging device, a microphone, a motion detector, a light sensor or the like. The sensors 112 may be strategically positioned about the vehicle 100 such that data can be detected in some or all directions from the vehicle 100.

The vehicle 100 can include any number of cameras 114. The cameras 114 may be any camera or optical sensor. The cameras 114 may be strategically positioned about the vehicle 100 such that image data can be captured in all directions from the vehicle 100.

In some embodiments, the vehicle 100 may include any number of additional sensors and/or in some embodiments, the cameras 114 can be replaced by any other sensor capable of detecting data corresponding to an environment of the vehicle 100. For example, a vehicle may include cameras, LIDAR devices, radar devices and microphones.

The vehicle 100 can include one or more environment sensors 116. The environment sensor 116 may be any sensor capable of detecting environment data corresponding to an environment of the vehicle 100. For example, the environment sensor 116 may be a moisture detector for detecting rain or foggy conditions, may be a light sensor for detecting an ambient light, may be a thermometer for detecting an ambient temperature, may be a debris sensor for detecting an amount of debris in the air or the like. The ECU 102 may determine current conditions of the environment of the vehicle 100 based on the received environment data. In some embodiments, at least one of mobile phone 118 or the cloud 122 may transmit environment data to the ECU 102 in addition to, or instead of, the environment sensor 116.

The ECU 102 may be electrically connected to some or all of the components of the vehicle 100. In an exemplary situation, the ECU 102 may receive detected data from the sensors 112 and/or the cameras 114. The ECU 102 may then determine potential hazard data corresponding to a potential hazard in the environment of the vehicle 100 based on the detected data. The ECU 102 may then transmit the potential hazard data to other vehicles, such as the vehicle 120.

For example, the camera 114F may detect that the vehicle 100 is traveling through a green traffic light at an intersection. The sensor 112A may also detect that a motorcycle is approaching the intersection. Based on the data from the sensor 112A, the ECU 102 may determine that the motorcycle is traveling too fast to stop at the traffic light and, thus, presents a potential hazard. The ECU 102 may transmit potential hazard data corresponding to the potential hazard to any other vehicles within a predetermined distance of the vehicle 100. The potential hazard data may include the detected hazard data from the sensors 112, such as image data or radar data, and/or may include any other information indicating that the motorcycle will run the stoplight.

Transmission of the potential hazard data provides several benefits and advantages to the other vehicles. For example, one of the vehicles may not sufficiently detect the oncoming motorcycle prior to reaching the intersection due to interference of other vehicles, limitations of its sensors or the like. However, the potential hazard data may provide sufficient information for the ECU to cause the vehicle to stop before the intersection (if the vehicle is autonomous) or for the driver to stop before the intersection (if the vehicle is driven).

The ECU may determine many types of potential hazards such as environmental hazards, hazards presented by other vehicles or the like. Exemplary environmental hazards include damage to a road, an object in a lane of traffic, a mudslide, a fire, a bad intersection (for example, if overgrown brush makes it difficult to see around turns) or the like. Exemplary hazards presented by other vehicles include a driver that is driving erratically or recklessly, a driver that appears impaired, an approaching emergency vehicle, a vehicle appearing likely to breach a right of way, a collision or the like.

Figure 2:
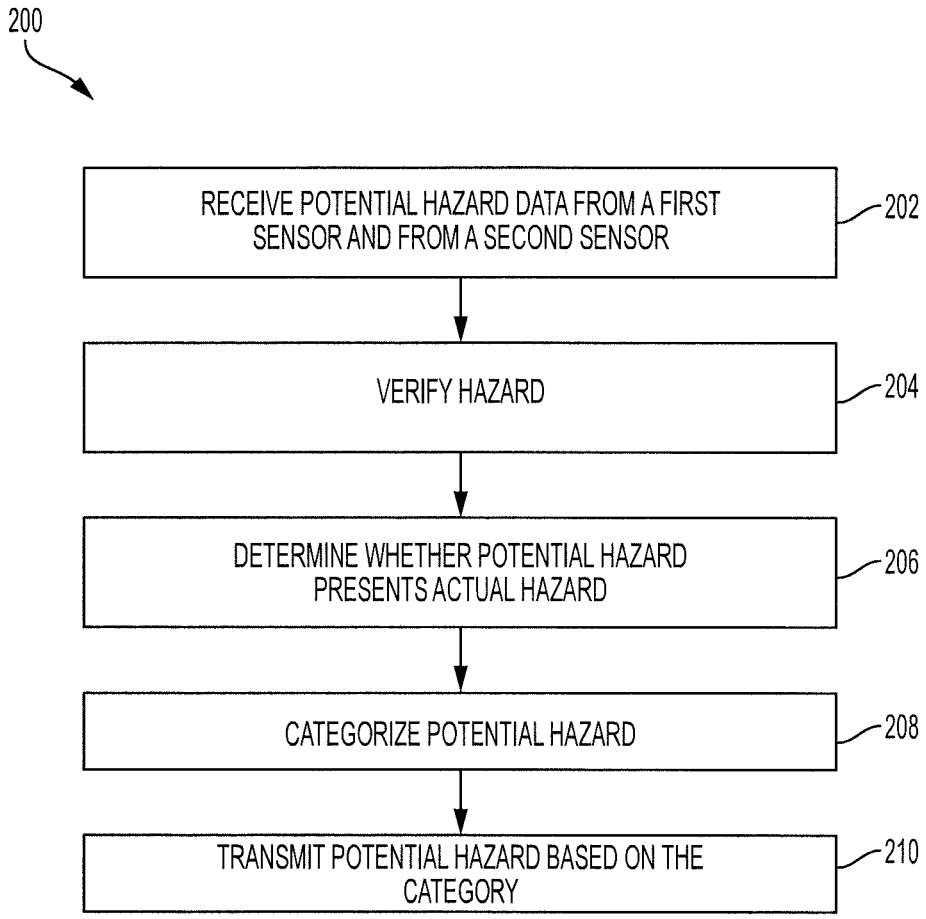
FIG. 2 is a flowchart illustrating a method for determining whether a potential hazard exists, determining a category of the potential hazard and distributing data corresponding to the potential hazard to an appropriate vehicle or authority based on the category according to an embodiment of the present invention.

Turning now to FIG. 2, a method 200 for detecting and transmitting hazard data to other vehicles and/or to authorities is shown. The method 200 may be performed by an ECU of a vehicle, such as the ECU 102 of the vehicle 100 of FIG. 1. The method 200 begins at block 202 where the ECU may receive detected data from a first sensor and from a second sensor. Data can be received from any number of sensors and is not limited to two types of sensors. For example, the vehicle may include cameras, radar devices and directional microphones.

Use of two or more types of sensors provides advantages over use of a single type of sensor. One such advantage is detection of potential hazards that one type of sensor may be incapable of detecting. Some sensors may detect data at a higher resolution than others may, some sensors may be better suited for detecting data in certain situations, some sensors may be incapable of detecting certain data or the like. For example, a radar device may be incapable of detecting image data but may detect speeds at a higher resolution than a camera.

The use of microphones as sensors in a vehicle provides advantages, particularly in certain situations. For example, a microphone may be the only sensor capable of detecting an approaching fire truck if there is a lot of traffic or if the road is tree-lined and curvy. The audio data from the microphone can also be analyzed by the ECU to determine other information. For example, the ECU can analyze the audio data to deter line whether the ambulance is traveling towards or away from the vehicle by analyzing the audio data based on the Doppler Effect.

In block 204, the ECU may verify that the potential hazard actually exists. This may be done by analyzing and comparing the data detected by each of the sensors. For example, the ECU may verify the existence of the potential hazard when detected data from each sensor indicates the same potential hazard. The verification may also be based on current environmental conditions. In foggy conditions, for example, the ECU may verify whether a potential hazard exists based on data from a radar device instead of a camera because radar technology is more accurate in the fog.

Figure 3:
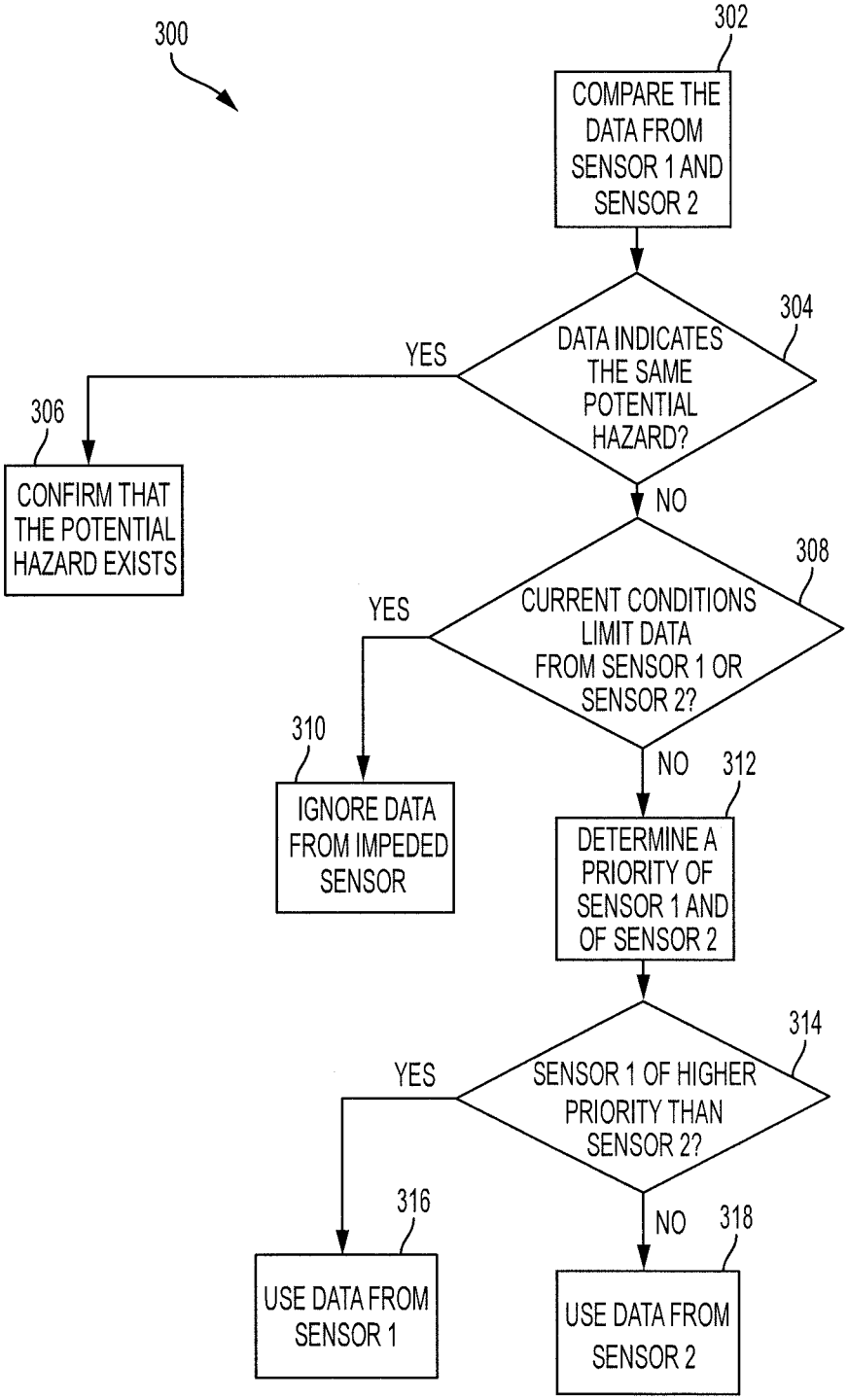
FIG. 3 is a flowchart illustrating a method for verifying whether a hazard exists based on data detected by at least two different types of sensors according to an embodiment of the present invention.

Turning now to FIG. 3, a method 300 for verification of potential hazards is shown. The method 300 may be substituted into block 204 of the method 200 of FIG. 2.

The method 300 begins in block 302 where the ECU compares data detected from at least two types of sensors. The ECU may determine whether the detected data indicates the presence of a potential hazard based on this comparison. In some embodiments, data from all sensors of the vehicle is compared, and in some embodiments, only data from sensors in position to detect the potential hazard are compared. For example, the ECU may only compare data from sensors on its passenger side if a motorcycle is traveling towards the passenger side.

Data from each sensor and/or each type of sensor may occasionally indicate different results. For example, in foggy conditions, camera data may indicate that no potential hazard exists while radar data may indicate that the potential hazard exists. In block 304, the ECU determines whether the data from both types of sensors indicates the presence of the potential hazard.

The ECU may confirm that the potential hazard exists in block 306 if the data from both types of sensors indicates that the potential hazard is present. If the data from the sensors do not both indicate that the potential hazard exists, the method 300 may proceed to block 308.

In block 308, the ECU determines whether current conditions of the vehicle or the environment of the vehicle limits the sensing capabilities of the vehicle's sensors. For example, the ECU may receive environmental condition data from the environment sensor. The ECU may then determine whether the current environmental conditions limit the capabilities of one or more sensors based on the environmental condition data. For example, the environment sensor may detect that the ambient moisture near the vehicle is relatively high and, thus, capabilities of the cameras are limited. As another example, the ECU may determine that one or more sensor is not currently receiving power and, thus, its capabilities are limited.

If the current conditions do limit data from one or more sensor, the ECU may ignore the data from the affected sensor in block 310. The ECU may then determine whether the potential hazard exists based on the data from the non-affected sensor(s). For example, if the current conditions are foggy, the ECU may ignore camera data and determine whether the potential hazard exists based on radar data.

If the current conditions do not limit data collection from one or more sensors, the ECU may determine a priority of each of the sensors in block 312. Higher priority sensors may be associated with a high likelihood of accuracy. The priority of each sensor may be based on one or more factors. One such factor for determining sensor priority may include the type of hazard being detected. For example, if the hazard is an oncoming emergency vehicle, a directional microphone may be assigned a higher priority than a camera. Another factor may include the resolution of data received from the sensors. For example, if a radar device is designed to have higher speed detection capabilities than a camera, then the radar device may be assigned a higher priority than the camera for speed detection data. The priority value of each sensor may also or instead be preassigned. For example, each sensor may be assigned a particular priority value.

If the ECU determines that a first sensor has a priority greater than a second sensor in block 314, the ECU may determine whether the potential hazard exists based on the data from the first sensor in block 316. If the second sensor has a priority greater than the first sensor, the ECU may determine whether the potential hazard exists based on the data from the second sensor in block 318. In some embodiments, the ECU may determine that a potential hazard exists when the priorities of the first sensor and the second sensor are the same and only one sensor indicates the presence of the potential hazard.

Returning now to FIG. 2, after verification of the potential hazard in block 204, the ECU may determine whether the potential hazard presents an actual hazard in block 206. Block 206 is optional, and whether it is performed may be dependent upon the type of potential hazard. For example, block 206 may not be performed when the potential hazard is the detection of an object on the road.

Figure 4:
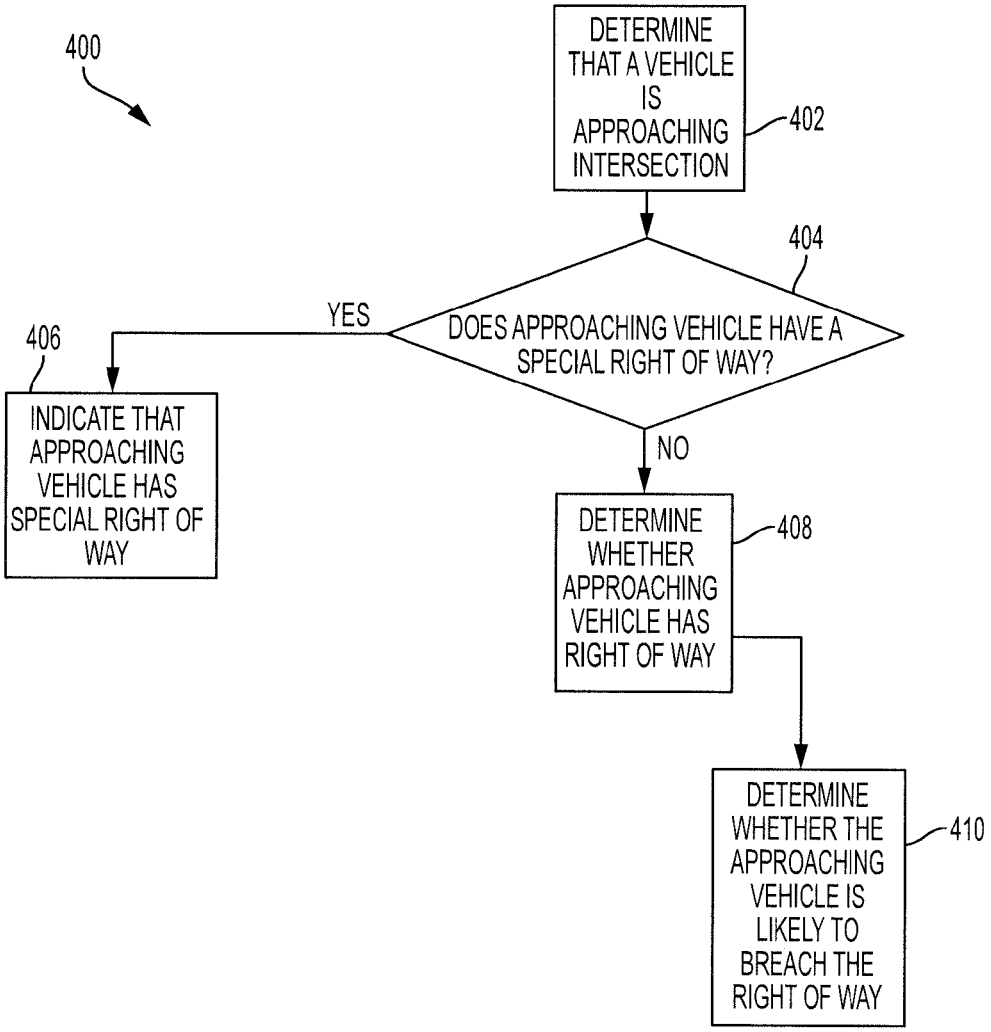
FIG. 4 is a flowchart illustrating a method for determining whether a potential hazard is likely to present an actual hazard based on hazard data detected by sensors according to an embodiment of the present invention.

Turning to FIG. 4, an exemplary method 400 for determining whether a potential hazard presents an actual hazard is shown. The method 400 can replace block 206 of the method 200 of FIG. 2. The method 400 corresponds to a situation in which another vehicle appears likely to travel through an intersection without right of way or with a special right of way. Other methods may be used in place of the method 400 to determine whether other types of potential hazards present actual hazards.

The method 400 begins at block 402 where the ECU may determine that another vehicle is approaching an intersection.

In block 404, the ECU may determine whether the approaching vehicle has a special right of way. A special right of way refers to a situation in which a vehicle would not normally have a right of way but currently does due to special circumstances. For example, a police car with flashing emergency lights may legally run a red light when other vehicles cannot. Determination of special right of ways may be based on detected data. For example, image data from a camera may indicate that the vehicle is an emergency vehicle with its lights flashing.

In some embodiments, the ECU may determine that the other vehicle has a special right of way based on data received from the network access device instead of, or in addition to, the data detected by the sensors. For example, an emergency vehicle or a dispatcher may transmit a signal indicating that an emergency vehicle is approaching an intersection. The ECU may receive this signal and determine that the approaching vehicle has a special right of way through the intersection based on the received information.

In block 406, if the approaching vehicle has a special right of way, the ECU will store data indicating the special right of way. Otherwise, the ECU will determine whether the approaching vehicle has a traditional right of way in block 408.

The ECU may determine whether the approaching vehicle has a traditional right of way based on detected data from the sensors. For example, if a camera detects that the approaching vehicle has a stop sign at the intersection, the ECU will determine that the approaching vehicle does not have a traditional right of way. A current right of way status may also be determined based on data received via the network access device. For example, the ECU may receive data from a device associated with a traffic light indicating which lanes of traffic have a current right of way. If the approaching vehicle does have a traditional right of way, the method 400 will end.

If the approaching vehicle does not have the right of way, the ECU may then determine whether the approaching vehicle is likely to breach the right of way in block 410. This may be determined based on detected data. For example, if radar data indicates that the approaching vehicle is not decelerating as it approaches the intersection, the ECU may determine that the approaching vehicle is likely to breach the right of way.

If the approaching vehicle is decelerating, the ECU may determine whether it is likely to breach the right of way based on one or more of a current speed of the approaching vehicle, a current rate of deceleration of the approaching vehicle or a distance between the approaching vehicle and the intersection. For example, if the approaching vehicle is 100 feet from the intersection and traveling at 45 miles per hour (mph), the ECU may determine that the approaching vehicle is not likely stop due to the high deceleration rate required for the vehicle to stop.

Returning reference to FIG. 2, it may be desirable for the ECU to perform different actions for different potential hazards. Thus, the ECU may assign a category to the potential hazard in block 208 based on the detected data. A different action may be taken for each category of potential hazards. In some embodiments, the categories may be delimited based on a level of severity. For example, an ECU may categorize potential hazards as emergency hazards, hazards likely to cause a dangerous situation or disturbances. Emergency hazards are hazards in which it is desirable for emergency personnel to be notified, such as fires. Hazards likely to cause dangerous situations include approaching emergency vehicles. Disturbances are not as likely to cause dangerous situations and may include potential hazards such as heavy traffic.

In some embodiments, the ECU may be capable of receiving requests to be on the lookout for a person or an object. These requests may correspond to another category of hazards. For example, a law enforcement agency may transmit data corresponding to a stolen vehicle including an image of the stolen vehicle and text corresponding to its license plate. The ECU may receive this data and identify the stolen vehicle by comparing the received data to data detected from the sensors.

After categorizing the hazard, the ECU may take one or more action based on the category. The action may include, for example, transmitting potential hazard data to various entities in block 210. For example, the ECU may determine the presence of a wreck, determine that the wreck should be categorized as an emergency and transmit emergency hazard data to a hospital, a fire station, a police station and nearby vehicles. The type of hazard data transmitted to the various entities may include one or more of a description of the hazard, some or all of the detected data (such as image, video or audio data), a category of the hazard, a location of the hazard or the like.

Figure 5:
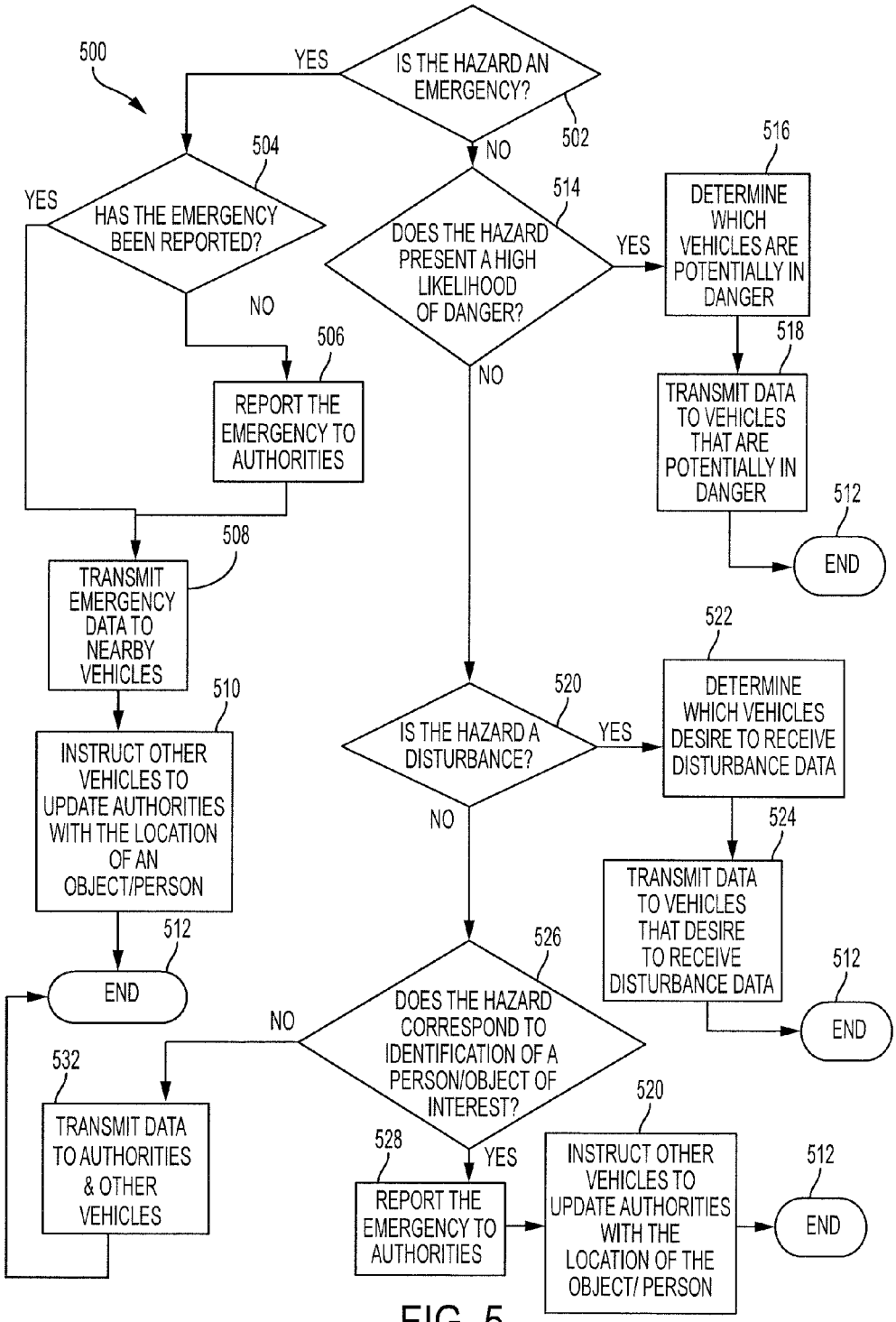
FIG. 5 is a flowchart illustrating a method for categorizing a potential hazard based on detected data and determining whether to transmit data corresponding to the potential hazard to other vehicles, authorities or both based on the category according to an embodiment of the present invention.

Turning now to FIG. 5, a method 500 for transmitting the potential hazard data based on the determined category is shown. The method 500 may be substituted into block 210 of the method 200 of FIG. 2. The method 500 begins at block 502 where the ECU determines whether the hazard is an emergency.

If the hazard is an emergency, the ECU determines whether the emergency has been reported to authorities in block 504. This may be determined in various manners. For example, the ECU may query a database, such as via the network access device, to determine whether a particular hazard has been reported. In some embodiments, another vehicle may have already detected and transmitted the emergency to nearby vehicles and the authorities. The ECU may receive this data and determine that the other vehicle has transmitted potential hazard data to the authorities.

In block 506, if the emergency has not been reported to authorities, the ECU may report the hazard data to the authorities. For example, the ECU may transmit the potential hazard data directly to emergency vehicles that are within a predetermined distance of the vehicle via the network access device. In some embodiments, the ECU may transmit the potential hazard data to a server via the cloud. Based on the current location of the vehicle, the server may transmit the potential hazard data to emergency vehicles within a predetermined distance of the vehicle. In some embodiments, the ECU may transmit the hazard data to a dispatch or headquarters associated with the authorities, such as a police station or a hospital.

In block 508, the ECU may transmit the emergency data to nearby vehicles. The data may be transmitted to some or all vehicles within a predetermined distance of the vehicle.

In some embodiments, the ECU may calculate the predetermined distance based on various factors such as a speed limit of the road, a current speed of traffic, visibility along the road or the like. For example, if the speed limit of the road is high and the visibility is low, the vehicle may transmit the potential hazard data to vehicles within a relatively large distance of the vehicle. However, if visibility is high and the speed limit is low, the vehicle may transmit the potential hazard data to vehicles within a relatively small distance of the vehicle. In some embodiments, the predetermined distance may be limited by the range of the network access device.

In some situations, it may be desirable for vehicles to continue to update the authorities with the location of a person or an object. For example, the ECU may determine that a driver of a vehicle appears to be driving drunk. In such a situation, it may be desirable for the authorities to continue to receive data corresponding to the location of the drunk driver. In these situations, the ECU may also transmit a request for other vehicles to continue to update the authorities with the location of the vehicle in block 510. The method may then end in block 512.

If the hazard is not an emergency, the ECU may determine whether the hazard presents a high likelihood of danger in block 514. If so, the ECU may determine which vehicle or vehicles are potentially in danger in block 516. For example, the ECU may determine that vehicles within a certain distance are likely to be in danger based on a speed limit, current speed of traffic, visibility or the like. The ECU may then determine that vehicles within the distance are potentially in danger.

In some embodiments, the ECU may determine which lane or lanes of traffic are affected based on the location of the potential hazard and determine that vehicles currently or likely to be in the affected lane or lanes of traffic are potentially in danger. For example, if a wreck has occurred on a westbound lane of a highway, the ECU may determine that vehicles traveling on westbound lanes are potentially in danger.

After determining which vehicles are potentially in danger, the ECU may transmit the hazard data to the vehicles that are potentially in danger in block 518. In some embodiments, the vehicle may always transmit hazard data to all vehicles in range of the network access device regardless of whether or not they are potentially in danger.

In block 520, the ECU may determine whether the hazard corresponds to a disturbance. Some vehicles or drivers may wish not to receive any disturbance data. In block 522, the ECU may determine which vehicles prefer to receive disturbance data and which vehicles prefer not to receive disturbance data. The ECU may then transmit the disturbance data to vehicles that desire to receive the disturbance data in block 524.

In block 526, the ECU may determine whether the hazard corresponds to a request from authorities to be on the lookout for a particular person or object. For example, the authorities may transmit identification information such as image data, text data or the like corresponding to a vehicle or person to be on the lookout for. The ECU may receive this data via the network access device. In some embodiments, this type of request can be automatically generated when an amber alert is issued.

After receiving this data, the ECU may continuously analyze the detected data and compare it to the received data. In some embodiments, the vehicle continuously monitors the detected data to determine if the particular person or object has been detected. When the ECU identifies the object of the search, the ECU may transmit location data and any detected data corresponding to the object to the authorities in block 528. In block 530, the ECU may cause the network access device to transmit a request that other vehicles in the same area continuously update the authorities with the location of the search object. This increases the likelihood that the authorities will be able to find the search object.

In block 532, if the hazard data is not categorized, the ECU may transmit the data to authorities and to other vehicles. This reduces the likelihood of serious potential hazards going undetected.

With brief reference to FIG. 2, in some embodiments, the method 200 may be performed by a driver or passenger and a mobile device. For example, a passenger may notice a potential hazard while driving. The passenger may then capture the data using a personal device, such as a mobile phone. The mobile phone or the ECU (via the I/O port) may be capable of determining whether a potential hazard exists, categorizing the hazard and transmitting potential hazard data based on the detected data.

Turning now to FIG. 6, database 600 shows exemplary hazard categories and associated information. The database 600 shows exemplary hazards in each category, to whom to transmit the hazard data for each category and what hazard data to transmit for each category.

Although four categories are shown, one skilled in the art will realize that any number of categories can be included. The first category includes emergency hazards. Potential emergency hazards include including detection of a drunk driver, a fire or a wreck on the road. Data corresponding to these hazards is to be transmitted to emergency personnel and all vehicles potentially in danger or within a predetermined distance of the vehicle. Because of the nature of emergencies, all relevant data is to be transmitted including any analysis of the data, all of the detected data, location data and the like.

Exemplary hazards that present a high likelihood of danger include detection of approaching emergency vehicles and vehicles breaching their right of way. Data corresponding to these potential hazards is transmitted to all vehicles in range and/or all vehicles that are potentially in danger from the hazard. The data that is transferred is the current location of the hazard, the location of potential future danger, any detected data or the like.

Exemplary disturbances include detection of traffic, potholes, objects in the road or the like. Hazard data for the disturbances may only be transmitted to vehicles that have selected to receive such data. The data that is transferred may include the location of the disturbance, the type of disturbance, any detected data corresponding to the disturbance or the like.

Exemplary identifications of persons or objects of interest may include detection of a stolen car, a fugitive, an amber alert subject or the like. The data corresponding to the identified subject is transferred to the corresponding emergency personnel. The information that is transferred may include the location of the person or object, identification of the person or object, any detected data corresponding to the person or object or the like. Furthermore, some requests may be transmitted to other vehicles. For example, the vehicle may request that other vehicles continue to transmit location updates regarding the person or object.

Figure 7:
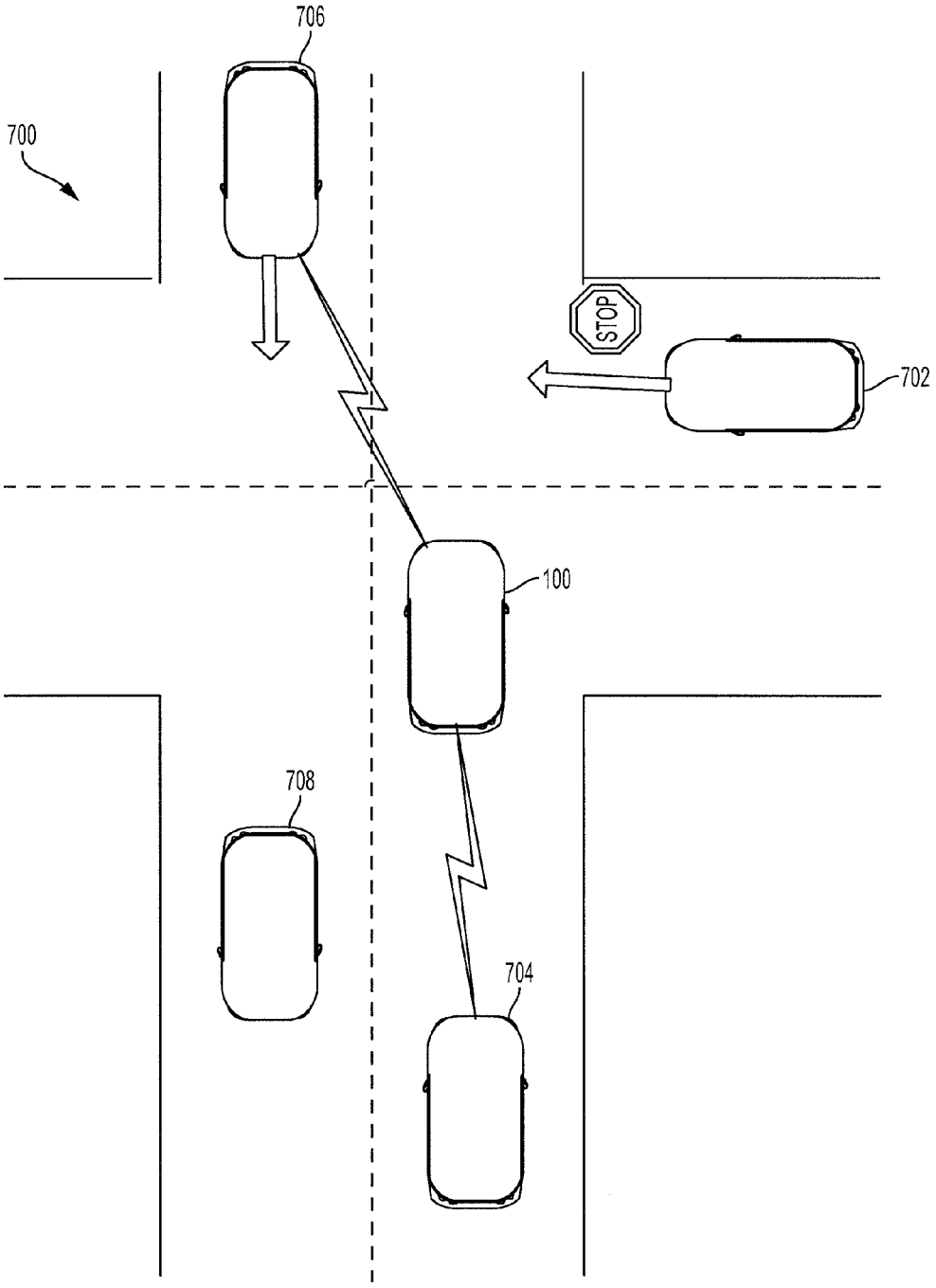
FIG. 7 is a drawing of an intersection of a road showing an exemplary use of the method of FIG. 2 according to an embodiment of the present invention.

Turning now to FIG. 7, a map 700 shows an exemplary use of a method similar to the method 200 of FIG. 2. The vehicle 100 may be driving along the road and detect that another vehicle 702 is traveling towards an intersection. The vehicle 100 may determine that the vehicle 702 does not have a right of way due to detection of the stop sign. The vehicle 100 may analyze the detected data and determine that the vehicle 702 is likely to breach its right of way. For example, the vehicle 100 may determine that the vehicle 702 is traveling at too high of a speed to be capable of stopping prior to reaching the intersection. Based on this data, the vehicle 100 may categorize the potential hazard as having a high likelihood of danger.

The vehicle 100 may then determine that all vehicles approaching the intersection should be notified of the potential hazard. These vehicles include a vehicle 704 traveling behind the vehicle 100 and a vehicle 706 traveling in the opposite direction that has not yet entered the intersection. The vehicle 100 may determine that a vehicle 708 is not in a position of danger because it has already traveled through the intersection. The vehicle 100 may then transmit the potential hazard data to the vehicle 704 and the vehicle 706, but not to the vehicle 708.

Figure 8:
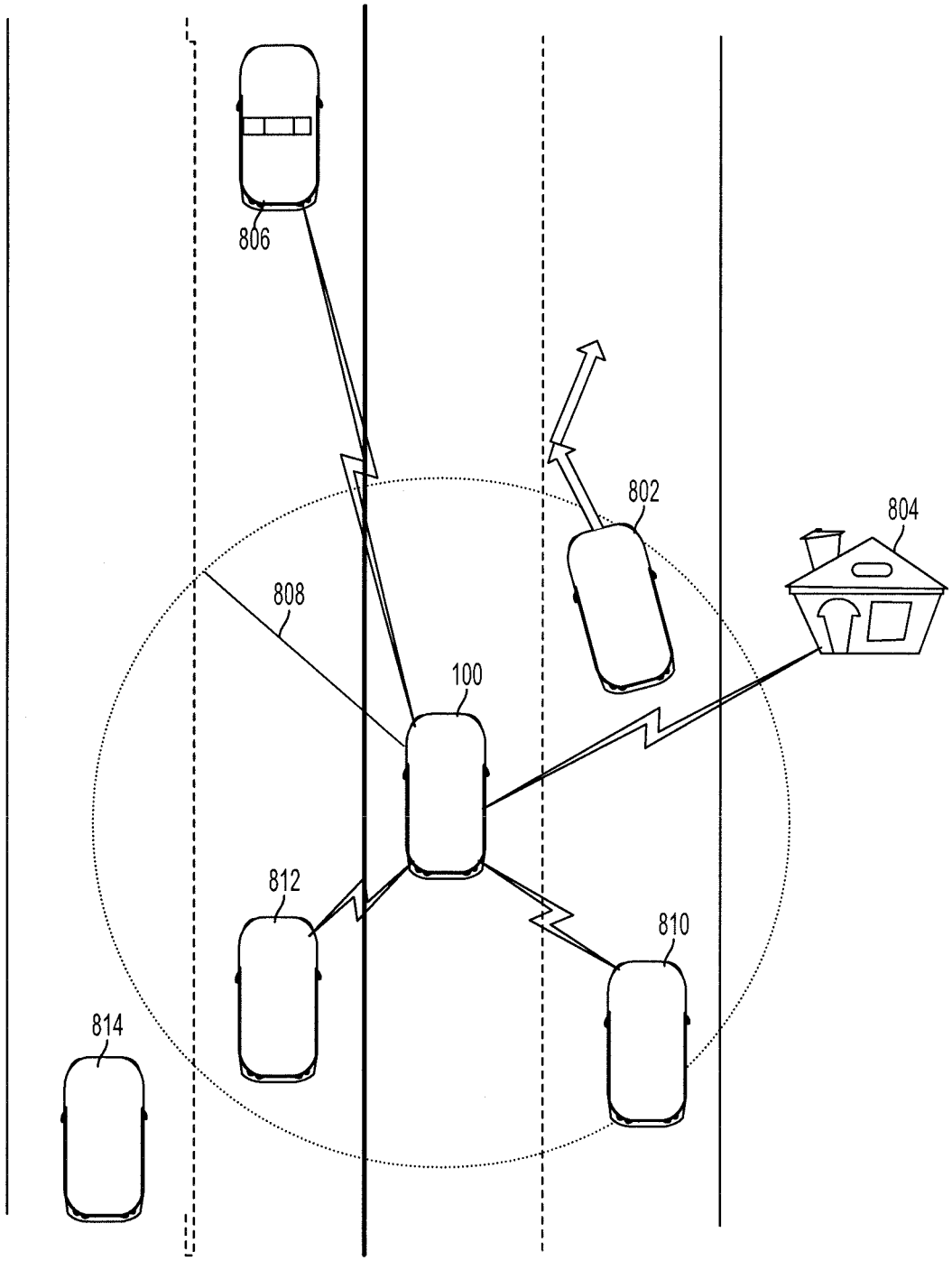
FIG. 8 is a drawing of a portion of a road showing another exemplary use of the method of FIG. 2 according to an embodiment of the present invention.

Turning now to FIG. 8, another map 800 shows another implementation of a method similar to the method 200 of FIG. 2. The vehicle 100 may be traveling along a road and detect that another vehicle 802 is driving erratically because its driver may be drunk. Thus, the vehicle 100 may categorize the potential hazard as an emergency.

Because the potential hazard is an emergency, the vehicle 100 may transmit data corresponding to the potential hazard to a police station 804. The vehicle 100 may also transmit data corresponding to the potential hazard to a police car 806.

The vehicle 100 may also transmit the hazard data to any vehicles within a predetermined distance 808 of the vehicle 100 and that are potentially in danger. This includes a vehicle 810 and a vehicle 812. In some embodiments, if a divider is present between the lanes of the vehicle 100 and the vehicle 812, the vehicle 100 may not transmit the hazard data to the vehicle 812 as it may be deemed potentially not in danger. A vehicle 814 farther from the vehicle 100 than the distance 808 may not be notified.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A system for transmitting data corresponding to hazards from a first vehicle to a second vehicle comprising:

a first sensor configured to detect first hazard data corresponding to a potential hazard;

a second sensor configured to detect second hazard data corresponding to the potential hazard, the second sensor having different functionality than the first sensor;

a network access device configured to receive and transmit signals; and an electronic control unit (ECU) coupled to the first sensor, the second sensor and the network access device and configured to:

determine whether the potential hazard exists based on the first hazard data and the second hazard data, determine a category corresponding to the potential hazard, and instruct the network access device to transmit potential hazard data corresponding to the potential hazard to the second vehicle that is within a predetermined distance of the first vehicle when the category is a first category.

2. The system of claim 1 wherein the ECU is further configured to determine whether the potential hazard exists by comparing the first hazard data to the second hazard data and confirming that the potential hazard exists when at least one of:

the first hazard data and the second hazard data both indicate that the potential hazard exists, current conditions of an environment of the first vehicle limit capabilities of the first sensor and the second hazard data from the second sensor indicates that the potential hazard exists, or the first sensor has a higher priority than the second sensor and the first hazard data from the first sensor indicates that the potential hazard exists.

3. The system of claim 2 further comprising an environment sensor coupled to the ECU and configured to detect the current conditions of the environment of the first vehicle.

4. The system of claim 2 wherein a priority of the first sensor and a priority of the second sensor are determined based on at least one of a type of the potential hazard, a resolution of each of the first sensor and the second sensor, or a predetermined priority weight assigned to each of the first sensor and the second sensor.

5. The system of claim 1 wherein the potential hazard corresponds to a third vehicle traveling towards an intersection and wherein the ECU is further configured to determine whether the potential hazard presents an actual hazard based on at least one of whether the third vehicle has a traditional right of way, whether the third vehicle has a special right of way, or whether the third vehicle is likely to breach the traditional right of way.

6. The system of claim 1 wherein the ECU is further configured to transmit the potential hazard data to authorities when the category is the first category.

7. The system of claim 1 wherein the ECU is further configured to determine that the second vehicle is potentially in danger based on the first hazard data and the second hazard data and to instruct the network access device to transmit the potential hazard data to the second vehicle in response to determining that the second vehicle is potentially in danger.

8. The system of claim 1 wherein the potential hazard data includes a request for the second vehicle to transmit location data corresponding to a location of the potential hazard to authorities.

9. A system for transmitting data corresponding to a hazard from a first vehicle to a second vehicle comprising:

a camera configured to detect image data corresponding to a third vehicle;

a radar device or a Light Detection and Ranging (LIDAR) device configured to detect wave data corresponding to the third vehicle;

a network access device configured to receive and transmit signals; and an electronic control unit (ECU) configured to:

determine whether the third vehicle presents a potential hazard based on the image data and the wave data, determine a category of the potential hazard based on the image data and the wave data, determine that potential hazard data corresponding to the potential hazard should be transmitted to the second vehicle when the category of the potential hazard is a first category, and instruct the network access device to transmit the potential hazard data to the second vehicle.

10. The system of claim 9 wherein the ECU is further configured to determine that the second vehicle has requested to receive all potential hazard data corresponding to a second category and to instruct the network access device to transmit the potential hazard data to the second vehicle when the category of the potential hazard is the second category.

11. The system of claim 9 wherein the ECU is further configured to determine whether the potential hazard exists by comparing the image data to the wave data and confirming that the potential hazard exists when at least one of:

the image data and the wave data both indicate that the potential hazard exists, current conditions of an environment of the first vehicle limit capabilities of the camera and the wave data from the radar device or the LIDAR device indicates that the potential hazard exists, or the camera has a higher priority than the radar device or the LIDAR device and the image data from the camera indicates that the potential hazard exists.

12. The system of claim 11 wherein a priority of the camera and a priority of the radar device or the LIDAR device are determined based on at least one of a type of the potential hazard, a resolution of each of the radar device or the LIDAR device and the camera, or a predetermined priority weight assigned to the radar device or the LIDAR device and the camera.

13. The system of claim 9 wherein the potential hazard corresponds to the third vehicle traveling towards an intersection and wherein the ECU is further configured to determine whether the potential hazard exists based on at least one of whether the third vehicle has a traditional right of way, whether the third vehicle has a special right of way, or whether the third vehicle is likely to breach the traditional right of way.

14. The system of claim 9 wherein the ECU is further configured to transmit the potential hazard data to at least one of an emergency vehicle or a location associated with emergency personnel when the category is the first category.

15. The system of claim 9 wherein the ECU is further configured to determine that the second vehicle is potentially in danger based on at least one of the image data or the wave data and to instruct the network access device to transmit the potential hazard data to the second vehicle in response to determining that the second vehicle is potentially in danger.

16. A method for detecting hazards by a first vehicle and transmitting hazard data to a second vehicle comprising:

detecting, by a first sensor, first hazard data;

detecting, by a second sensor having different functionality than the first sensor, second hazard data;

determining, by an electronic control unit (ECU), that a third vehicle is approaching an intersection;

determining, by the ECU, whether the third vehicle is a non-emergency vehicle and appears likely to breach a right of way or whether the third vehicle is an emergency vehicle based on the first hazard data and the second hazard data;

determining, by the ECU, that the third vehicle approaching the intersection presents a potential hazard when at least one of the third vehicle is the non-emergency vehicle and appears likely to breach the right of way or the third vehicle is the emergency vehicle; and transmitting, by a network access device, potential hazard data corresponding to the potential hazard to the second vehicle when the second vehicle is within a predetermined distance of the first vehicle.

17. The method of claim 16 further comprising determining, by the ECU, a category of the potential hazard and determining, by the ECU, whether to transmit the potential hazard data to authorities based on the category.

18. The method of claim 16 further comprising determining, by the ECU, whether the second vehicle is potentially in danger based on the first hazard data and the second hazard data and wherein transmitting, by the network access device, the potential hazard data to the second vehicle is performed in response to determining that the second vehicle is potentially in danger.

19. The method of claim 16 further comprising comparing, by the ECU, the first hazard data to the second hazard data and confirming, by the ECU, that the third vehicle approaching the intersection presents the potential hazard when at least one of:

the first hazard data and the second hazard data both indicate that the potential hazard exists, current conditions of an environment of the vehicle limit capabilities of the first sensor and the second hazard data from the second sensor indicates that the potential hazard exists, or the first sensor has a higher priority than the second sensor and the first hazard data from the first sensor indicates that the potential hazard exists.

20. The method of claim 16 wherein:

the third vehicle is the emergency vehicle, the first sensor is a microphone configured to detect audio data, and determining that the third vehicle is approaching the intersection includes analyzing, by the ECU, a Doppler Effect of the audio data.

* * * * *